US007296713B2

(12) United States Patent
Mineau et al.

(10) Patent No.: US 7,296,713 B2
(45) Date of Patent: Nov. 20, 2007

(54) ACTUATOR CAP AND PRODUCT REFILL FOR A HOUSING

(75) Inventors: Steven B. Mineau, Racine, WI (US); Timothy S. Yee, Racine, WI (US); David J. Houser, Racine, WI (US); William E. McCracken, Elmhurst, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 478 days.

(21) Appl. No.: 11/007,070

(22) Filed: Dec. 8, 2004

(65) Prior Publication Data

US 2006/0118577 A1 Jun. 8, 2006

(51) Int. Cl.
*B67D 5/06* (2006.01)

(52) U.S. Cl. ..... 222/182; 222/183; 222/325; 222/402.1; 222/402.13; 222/402.23; 222/402.24

(58) Field of Classification Search ..... 222/182–183, 222/321.8, 505, 402.1, 507, 402.13, 402.15, 222/402.21, 402.22, 402.23, 402.25, 325, 222/327, 402.24, 162
See application file for complete search history.

(56) References Cited

U.S. PATENT DOCUMENTS

| | | | | |
|---|---|---|---|---|
| 2,575,124 A | | 11/1951 | Pollitt | 222/162 |
| 2,673,008 A | | 3/1954 | Ryan | 222/162 |
| 2,766,913 A | | 10/1956 | Wilshusen | 222/394 |
| 2,941,700 A | | 6/1960 | Gable | 222/394 |
| 3,127,065 A | | 3/1964 | Stevenson | 222/164 |
| 3,128,916 A | * | 4/1964 | Picot | 222/183 |
| 3,161,196 A | | 12/1964 | Berkow | 128/225 |
| 3,247,655 A | | 4/1966 | Jacob | 56/255 |
| 3,318,492 A | | 5/1967 | Haas | 222/402.11 |
| 3,404,814 A | | 10/1968 | Wakeman | 222/402.13 |
| 3,516,424 A | | 6/1970 | Eagle | 132/148 |
| 3,618,833 A | | 11/1971 | Webster | 222/402.22 |
| 3,648,905 A | | 3/1972 | Kauder | 222/402.21 |
| 3,739,941 A | | 6/1973 | Ostrwosky et al. | 222/153 |
| 3,759,431 A | | 9/1973 | Vos | 222/402.22 |
| 3,760,988 A | | 9/1973 | Ostrowsky | 222/153 |
| 3,871,557 A | | 3/1975 | Smrt | 222/162 |
| 3,884,398 A | | 5/1975 | McLaughlin | 222/402.13 |
| 3,884,399 A | | 5/1975 | Matern | 222/402.13 |

(Continued)

FOREIGN PATENT DOCUMENTS

EP 0641727 A2 8/1994

(Continued)

OTHER PUBLICATIONS

U.S. Appl. No. 11/006,930, Office Action dated Jun. 1, 2007.

(Continued)

*Primary Examiner*—Frederick C. Nicolas

(57) ABSTRACT

An actuator cap for a container of product includes a main peripheral wall and a central discharge member axially movable relative to the main peripheral wall. The central discharge member is oriented to discharge product substantially axially. A pillar has a peripheral surface, and the pillar is deflectable relative to the main peripheral wall in a direction toward the central discharge member. Movement of the pillar is communicated to the central discharge member to displace the central discharge member when the pillar is deflected.

26 Claims, 7 Drawing Sheets

U.S. PATENT DOCUMENTS

| | | | | |
|---|---|---|---|---|
| 3,888,392 | A | 6/1975 | Van Coney | 222/108 |
| 3,907,175 | A | 9/1975 | Haas | 222/402.13 |
| 3,915,353 | A | 10/1975 | Haas | 222/402.1 |
| 3,946,911 | A | 3/1976 | Morane et al. | 222/402.11 |
| 3,987,942 | A | 10/1976 | Morane et al. | 222/402.15 |
| 4,013,231 | A | 3/1977 | Van Veldhoven | 239/579 |
| 4,077,548 | A | 3/1978 | Beard | 222/321 |
| 4,077,549 | A | 3/1978 | Beard | 222/321 |
| 4,087,027 | A | 5/1978 | Haas | 222/402.13 |
| 4,124,148 | A | 11/1978 | Vieler et al. | 222/321 |
| 4,132,359 | A | 1/1979 | Nozawa | 239/333 |
| 4,138,039 | A | 2/1979 | Micallef | 222/321 |
| 4,170,316 | A * | 10/1979 | LaBarbera | 220/799 |
| 4,186,855 | A | 2/1980 | Edman et al. | 222/321 |
| 4,277,004 | A | 7/1981 | Barlics | 222/402 |
| 4,378,081 | A * | 3/1983 | van Lit | 222/402.13 |
| 4,826,054 | A | 5/1989 | Frutin | 222/402.11 |
| 4,860,932 | A | 8/1989 | Nagy | 222/402.1 |
| 5,139,180 | A | 8/1992 | Lucas | 222/402.13 |
| 5,279,444 | A | 1/1994 | Williams | 222/1 |
| 5,287,998 | A | 2/1994 | Smrt | 222/402.1 |
| D347,263 | S | 5/1994 | Phillips | D23/231 |
| 5,307,959 | A | 5/1994 | Bedore et al. | 222/174 |
| 5,310,096 | A | 5/1994 | Rogers et al. | 222/402.13 |
| 5,335,832 | A | 8/1994 | De Laforcade | 222/402.13 |
| 5,358,147 | A | 10/1994 | Adams et al. | 222/183 |
| 5,411,184 | A | 5/1995 | Smrt | 222/402.13 |
| 5,503,303 | A * | 4/1996 | LaWare et al. | 222/153.12 |
| 5,518,148 | A | 5/1996 | Smrt | 222/174 |
| 5,702,036 | A | 12/1997 | Ferrara, Jr. | 222/402.13 |
| 5,743,431 | A | 4/1998 | Brattesani | 222/1 |
| 5,875,926 | A | 3/1999 | Schwartz | 222/79 |
| 5,875,934 | A * | 3/1999 | Miller et al. | 222/183 |
| 5,915,599 | A | 6/1999 | Takahashi | 222/402.13 |
| 5,971,226 | A | 10/1999 | Goncalves | 222/321.6 |
| 5,992,707 | A | 11/1999 | Gaichuk | 222/402.13 |
| 6,003,739 | A | 12/1999 | Bartlett et al. | 222/402.1 |
| 6,004,056 | A | 12/1999 | De Laforcade | 401/190 |
| 6,299,032 | B1 | 10/2001 | Hamilton | 222/402.15 |
| 6,321,742 | B1 | 11/2001 | Schmidt et al. | 126/38 |
| 6,340,103 | B1 | 1/2002 | Scheindel et al. | 222/402.15 |
| 6,386,397 | B2 | 5/2002 | Brotspies et al. | 222/321.6 |
| 6,390,336 | B1 | 5/2002 | Orozco | 222/162 |
| 6,543,653 | B2 | 4/2003 | Lamboux | 222/321.8 |
| 6,551,001 | B2 | 4/2003 | Aberegg et al. | 401/190 |
| D474,403 | S | 5/2003 | Fahy et al. | D9/448 |
| 6,569,387 | B1 * | 5/2003 | Furner et al. | 422/123 |
| 6,588,631 | B2 | 7/2003 | Sanchez | 222/402.13 |
| 6,592,011 | B1 * | 7/2003 | Lammel et al. | 222/402.11 |
| 2004/0028458 | A1 | 2/2004 | Heathcock et al. | 401/190 |
| 2004/0188473 | A1 | 9/2004 | Groh et al. | 222/402.13 |
| 2004/0222245 | A1 | 11/2004 | Marroncles | 222/402.13 |

FOREIGN PATENT DOCUMENTS

| | | |
|---|---|---|
| WO | WO 01/26995 | 4/2001 |
| WO | WO01/26995 A1 | 4/2001 |
| WO | WO03/024836 | 3/2003 |

OTHER PUBLICATIONS

U.S. Appl. No. 10/941,791, Office Action dated Apr. 6, 2007.

* cited by examiner

ACTUATOR CAP AND PRODUCT REFILL FOR A HOUSING

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to actuating apparatus, and more particularly to actuator caps that are placed on containers and used to dispense product from the containers.

2. Description of the Background of the Invention

Various apparatus for dispensing product from a container or reservoir of product have been developed. Smrt U.S. Pat. No. 5,287,998 discloses an actuator fitted to a container and including an axially extending passage therethrough for discharging product. The actuator includes a pair of wings that extend transversely from the actuator. The container may be moved axially within a device such that the wings bear against a surface defining a passage, thereby discharging product through the passage.

Brotspies et al. U.S. Pat. No. 6,386,397 discloses a spray bottle grip used with a nasal spray bottle. The grip is coupled to a reciprocating nozzle of the spray bottle, and two arms extend downwardly along the spray bottle. The arms include finger flanges that provide an ergonomic means of reciprocating the nozzle to dispense product from the spray bottle.

Haas U.S. Pat. No. 3,318,492 discloses a disc-shaped actuator attached to a nozzle of a container. A user may depress the actuator with his finger to dispense product from the container.

Scheindel et al. U.S. Pat. No. 6,340,103 discloses a handle extending along a container body. When a user pulls the handle toward the container body, a portion of the handle pushes downwardly upon a nozzle portion of the container to dispense product from the container.

Micallef U.S. Pat. No. 4,138,039 discloses a container having a vertically reciprocating tubular pump. A cap is fitted to the container and includes an actuator button extending from a sidewall of the cap. Movement of the actuator button in a direction toward the sidewall of the cap is translated into perpendicular reciprocating movement of the pump.

Other patents disclose devices having a container of product disposed at a first end of a rod and having a trigger mechanism at a second end of the rod wherein a user may actuate the container from a distance. Discharging product from a distance can be an advantage for many purposes, such as accessing hard-to-reach places or perhaps for discharging an insecticide into a hornet nest without placing oneself too close to the nest. Smrt U.S. Pat. No. 5,518,148 discloses a device where an actuating rod has a trigger on a first end and a container on a second end. Pulling the trigger moves the actuating rod longitudinally such that the second end of the rod moves a bell crank, which in turn, moves an additional rod that actuates a valve on the container. Aberegg et al. U.S. Pat. No. 6,551,001, assigned to the assignee of the present application and the disclosure of which is incorporated by reference herein, discloses a cleaning device having a trigger at a first end of a rod and a mop cleaning head and a container at a second end of the rod. Pulling the trigger moves a pivot link, which in turn actuates a valve of the container, thereby discharging product from the container onto the surface to be cleaned by the mop cleaning head.

Adams et al. U.S. Pat. No. 5,358,147, assigned to the present assignee and also incorporated herein by reference, discloses a container of air freshener inserted into a shroud. The shroud includes a nozzle that is fitted over a valve stem of the container. The combination of the container and the shroud is placed within a housing. When a user wishes to spray air freshener into ambient air, the user pushes the housing, which in turn pushes the shroud and the valve stem to dispense the air freshener out of the housing.

SUMMARY OF THE INVENTION

In accordance with one aspect of the present invention, an actuator cap for a container of product includes a main peripheral wall and a central discharge member axially movable relative to the main peripheral wall. The central discharge member is oriented to discharge product substantially axially. A pillar has a peripheral surface, and the pillar is deflectable relative to the main peripheral wall in a direction toward the central discharge member. Movement of the pillar is communicated to the central discharge member to displace the central discharge member when the pillar is deflected.

In accordance with a further aspect of the present invention, a product refill for a housing includes an actuator cap and a container of product. The actuator cap has a main peripheral wall, a central discharge member axially movable relative to the main peripheral wall and oriented to discharge product substantially axially. A pillar of the cap has a peripheral surface, and the pillar is radially deflectable relative to the main peripheral wall in a direction toward the central discharge member. Movement of the pillar is communicated to the central discharge member to displace the central discharge member when the pillar is deflected. A length between the peripheral surface and an axial centerline of the cap is greater than about one-quarter a largest lateral dimension across the product refill.

Other aspects and advantages of the present invention will become apparent upon consideration of the following detailed description.

DETAILED DESCRIPTION OF THE DRAWINGS

Figure 1:
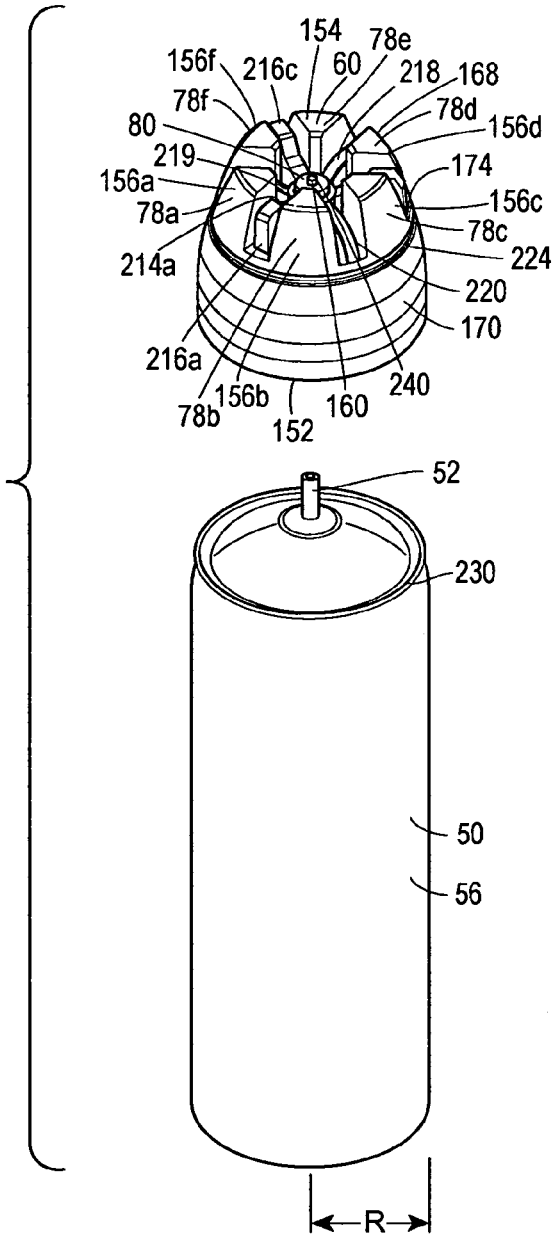
FIG. 1 is an exploded isometric view of a container and actuator cap.
Figure 2:
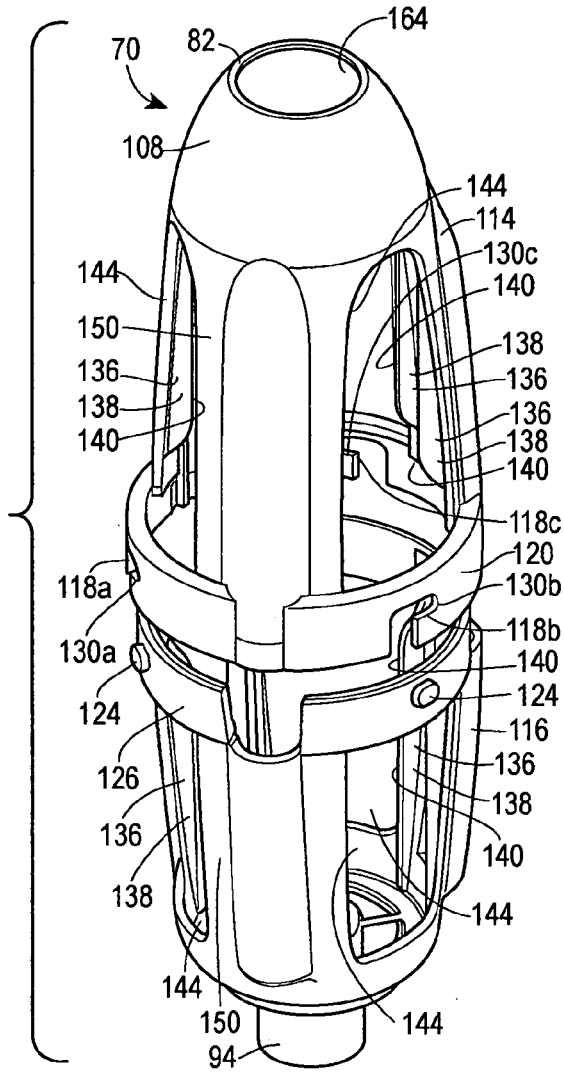
FIG. 2 is an exploded isometric view of a housing into which the container and actuator cap of FIG. 1 may be placed.
Figure 3:
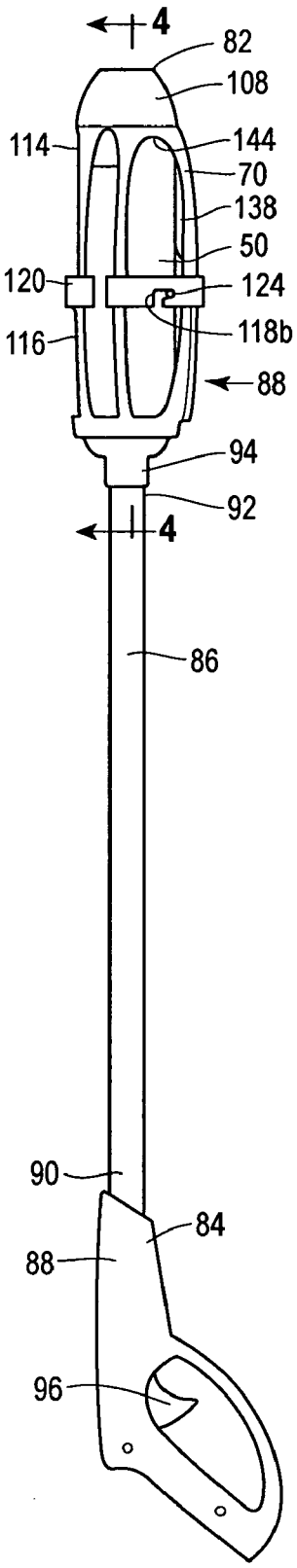
FIG. 3 is a side elevational view showing a rod and trigger mechanism in combination with the housing of FIG. 2.
Figure 4:
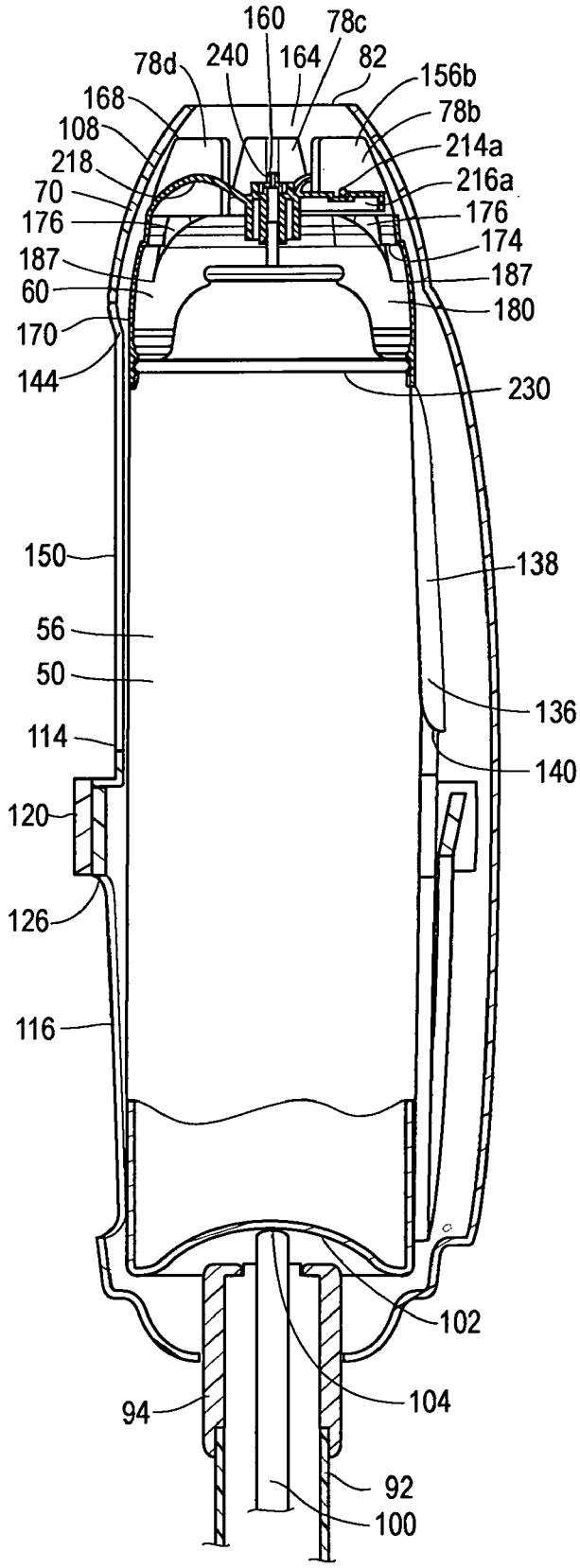
FIG. 4 is a sectional view taken generally along the lines 4-4 of FIG. 3 further illustrating the container of FIG. 1 in elevation and the actuator cap thereof in section.

Referring to FIG. 1, a container 50 has a valve stem 52 and a main body 56 containing product. The valve stem 52 could be either a vertically depressible valve stem or a tilt valve stem. As will be appreciated hereinafter, if a tilt valve stem is utilized such stem could also alternatively be depressed vertically without tilting to dispense product therethrough. It should be noted that the valve stem 52 could be replaced by any suitable apparatus that may be displaced to release product from the container 50. An actuator cap 60 is fitted to the container 50. FIG. 2 illustrates a housing 70 into which the container 50 and the actuator cap 60 may be placed. The container 50 and the actuator cap 60 are a product refill for the housing 70. It should be noted that the product refill may include additional components (not shown) besides the container 50 and the actuator cap 60, such as a sleeve (not shown) disposed around the container 50. The actuator cap 60 has deflectable valve actuating apparatus in the form of deflectable pillars 78*a*-78*f* and any suitable central adapter 80 secured to the valve stem 52. The housing 70 has a discharge opening 82 through which product stored within the container 50 may be dispensed. Referring to FIGS. 3 and 4, relatively moving the container 50 and the housing 70 such that the container 50 is moved toward the discharge opening 82 deflects the pillars 78, thereby actuating the valve stem 52 as described hereinbelow, causing product to be released from the container 50 and dispensed from the housing 70. A rod and trigger mechanism 84 may be used to move the container 50 within the housing 70. The mechanism 84 includes a hollow tube 86 with a handle assembly 88 at a first end 90 of the tube 86, and a second end 92 of the tube 86 is secured within a sleeve 94 of the housing 70 in any suitable manner such as by welding or appropriately threading the sleeve 94 and the end 92. Pulling a trigger 96 of the handle assembly 88 advances a push rod 100 disposed within the tube 86 against a bottom surface 102 of the container 50, thereby advancing the container 50 toward the discharge opening 82. If necessary or desirable, an end 104 of the push rod 100 may be shaped and/or fitted with a plate or other member to distribute forces more evenly across the bottom surface 102 of the container 50. Further, if desired, rather than moving the container 50 relative to the housing 70 by using the rod and trigger mechanism 84 one could move the container 50 and/or the housing 70 relative to one another by hand to dispense product.

The housing 70 includes a wall 108 that decreases in cross sectional size, tapering to the discharge opening 82. The discharge opening 82 has a cross sectional size greater than a radius R (FIG. 1) of the container 50. Referring again to FIG. 2, the housing 70 may include first and second wall portions 114, 116 that may be joined together to house the container 50 and the actuator cap 60 fitted thereto. The wall portion 114 may include three bayonet slots 118*a*-118*c* disposed on an end 120 of the portion 114 and equally spaced from one another by 120 degrees. To join the portions 114, 116, a user inserts pins 124 carried by an end 126 of the portion 116 into the slots 118*a*-118*c* and provides a relative rotation of the portions 114, 116 to seat the pins 124 within recessed regions 130*a*-130*c* of the slots 118.

Figure 6:
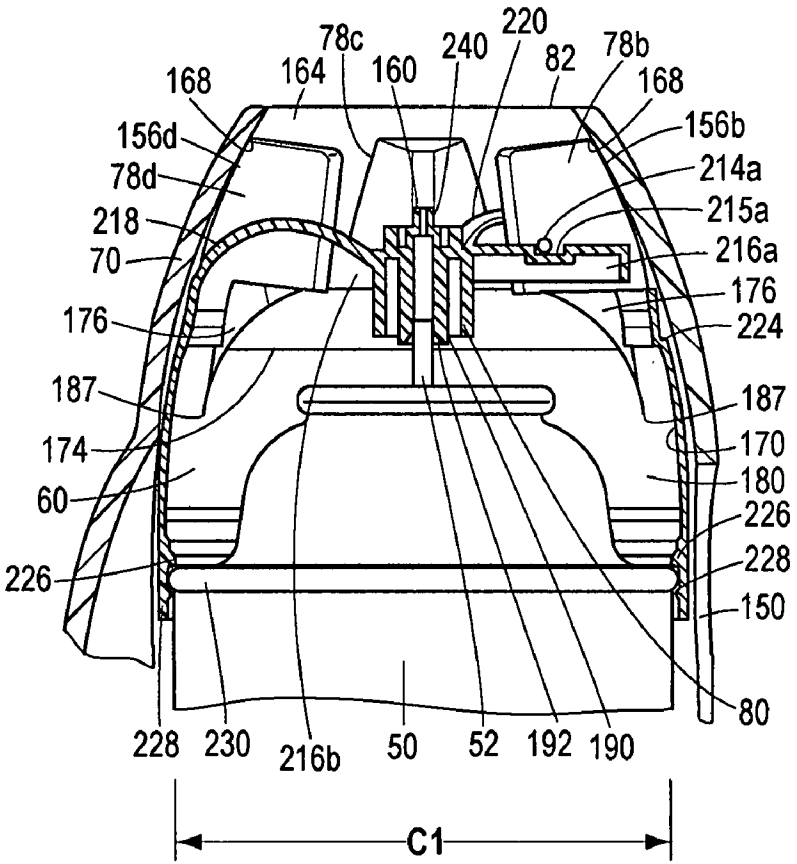
FIG. 6 is a view similar to FIG. 5, but showing the actuator cap of FIG. 1 in an actuating position.

Either of the portions 114, 116 may include protrusions 136 such as guide fins 138 having edges 140 that abut the exterior surface of the container 50 to center the container 50 within the housing 70. Either of the portions 114, 116 may include elongate openings or windows 144 that allow a user to see the container 50 when the container 50 is disposed within the housing 70. The housing portions 114, 116 may include three of the windows 144 spaced apart by 120 degrees. One advantage of the windows 144 is that a user might see any written directions or graphics disposed on the container 50. Referring to FIG. 6, a main region 150 of the wall portions 114 and 116 may have an inner cross sectional size C1 of about 66 mm, and thus the product refill, comprising the container 50 and the actuator cap 60, could have a cross sectional size of up to about 66 mm. In this regard, while a range of sizes is available for the container 50 one might wish to provide a container sized at or near maximum to provide a maximum useful life for the container 50 given the available space within the housing 70.

Figure 5:
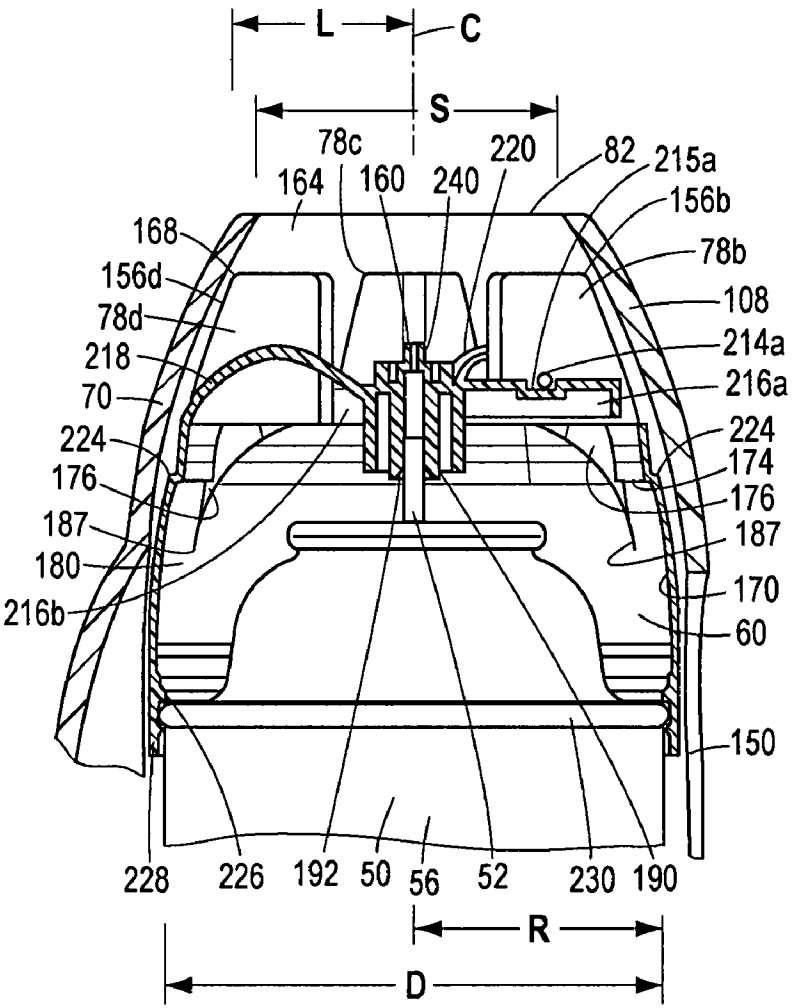
FIG. 5 is an enlarged fragmentary view of FIG. 4.
Figure 8:
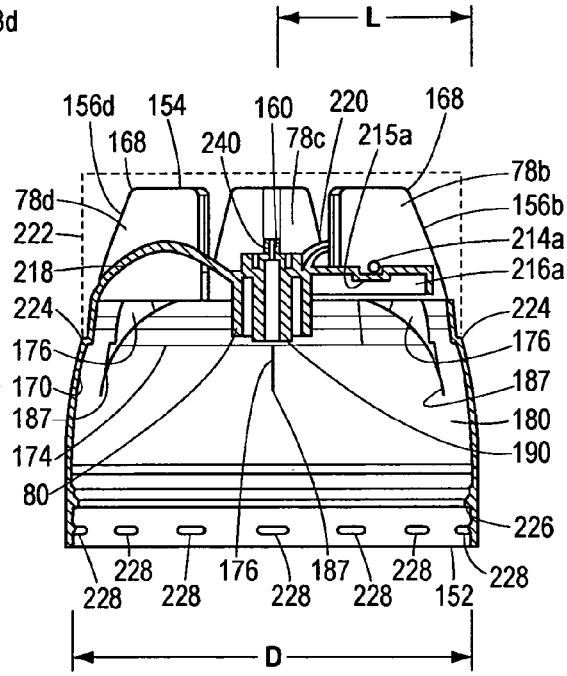
FIG. 8 is a sectional view taken generally along the lines 8-8 of FIG. 7.

Referring to FIG. 8, the actuator cap 60 decreases in cross sectional size along an axial dimension defined between a first end 152 for fitting to the container 50 and a second end 154. The actuator cap 60 provides a useful centering function in that peripheral surfaces 156*a*-156*f* of the pillars 78*a*-78*f* maintain a point of discharge 160 of the actuator cap 60 in a centrally located position relative to the discharge opening 82, thereby minimizing the potential for product impingement against a surface 164 of the tapered wall 108. The surfaces 156 may optionally be tapered. Referring also to FIG. 5, the pillars 78*a*-78*f* of the actuator cap 60 have a length L defined between a longitudinal centerline C (FIG. 5) of the cap 60 and a peripheral surface 168 of the pillars 78*a*-78*f*. The length L is selected relative to the inner dimensions of the tapered wall 108 such that the peripheral surface 168 is disposed in interfering relationship with the tapered wall 108. It should be appreciated that the actuator cap 60 and/or the pillars 78 could have any suitable shape so long as the pillars 78 are sized to have an interference relationship with the tapered wall 108. The length L may have any suitable value such as greater than about one-quarter (25%) a largest diameter of the product refill or greater than or equal to one-third (33%) the largest diameter of the product refill, whether the largest diameter is defined by the container 50, the actuator cap 60, or some other component of the product refill. The length L may be greater than one-quarter (25%) of a largest diameter D of the cap 60, measured at the first end 152. The length L may be greater than or equal to one-third (33%) the largest diameter D. Of course, the length L may be alternatively expressed relative to the size of the container 50. In any event, a largest lateral dimension across the product refill cannot exceed the internal cross sectional size C1 (FIG. 6) of the housing 70, and L may have any suitable value such as greater than one-quarter (25%) of this largest lateral dimension C1. One could select any suitable cross sectional size S (FIG. 5) for the discharge opening 82, such as a cross sectional size of about 34 mm, and suitable values of L might range between about 18 mm and about 33 mm to provide the above-described interfering relationship. A preferred value for L may be about 25 mm. It should be noted that while the tapered wall 108 of the housing 70 is illustrated as symmetrical around the longitudinal centerline C of the housing 70, the wall 108 could be made asymmetrical, greater in cross sectional size in one plane rather than another, and the shape of the actuator cap 60 could be made complementary therewith to serve as a keying function to orient the container 50 relative to the housing 70 in a particular angular orientation. This could be advantageous for various reasons, such as where product discharges in an asymmetrical pattern.

Figure 9:
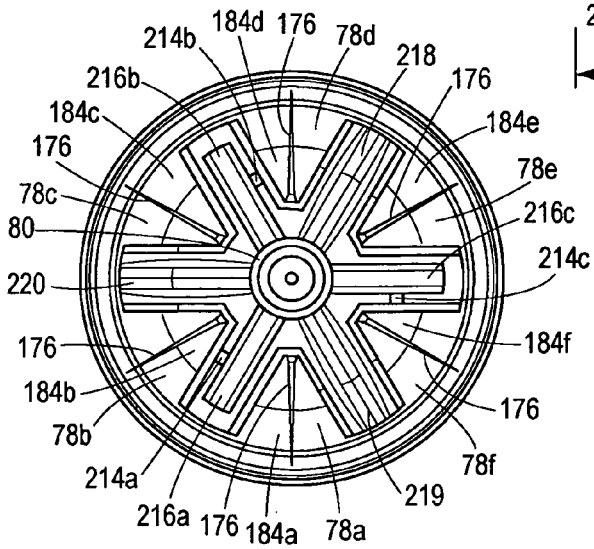
FIG. 9 is a bottom elevational view of the actuator cap of FIG. 1.

Referring to FIG. 8, the pillars 78 are cantilevered from a main peripheral wall 170 of the actuator cap 60, attached thereto at a hinge point 174. The pillars 78 are capable of being deflected radially inwardly toward the central adapter 80 about the hinge point 174. The pillars 78 are hollow, and arcuate strengthening ribs 176 bisect the hollow pillars 78. The ribs 176 connect an internal surface 180 of the main peripheral wall 170 to internal surfaces 184*a*-184*f* (FIG. 9) of the pillars 78. During deflection of the pillars 78, each of the pillars 78 moves unitarily. Referring to FIGS. 5, 6, and 8, a lower edge 187 of the ribs 176 may be positioned sufficiently close to the hinge point 174 such that the ribs 176 need not substantially flex during deflection of the pillars 78. The central adapter 80 is secured to the valve stem 52 as shown in FIGS. 5 and 6. The central adapter 80 includes a nozzle member 190 having a tapered surface 192 to facilitate insertion of the valve stem 52 therein.

Figure 7:
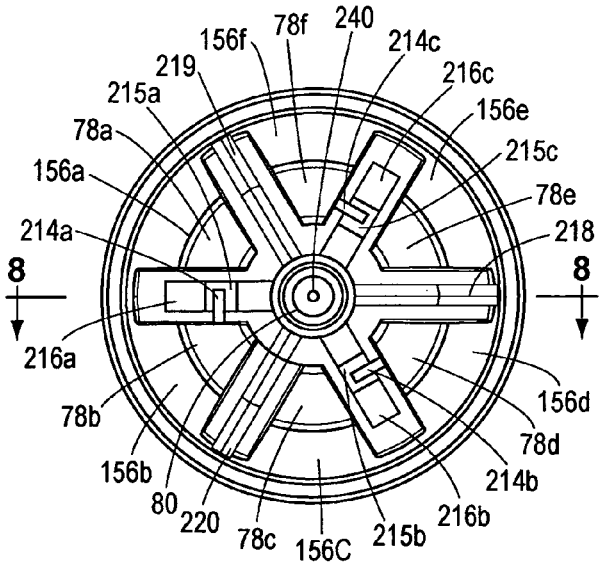
FIG. 7 is a plan view of the actuator cap of FIG. 1.
Figure 10:
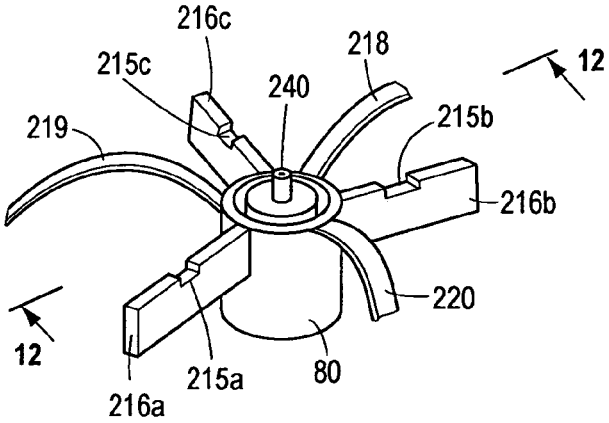
FIG. 10 is an enlarged fragmentary isometric view of components of the actuator cap of FIG. 1.
Figure 11:
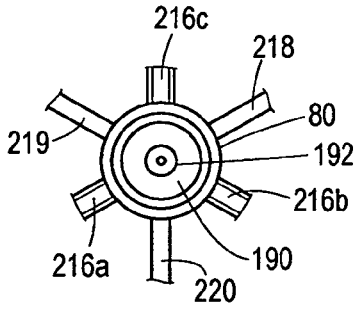
FIG. 11 is an enlarged fragmentary bottom elevational view of the components of the actuator cap of FIG. 1.

Referring to FIGS. 7, 8, and 10, the pillars 78*b*, 78*d*, and 78*f* carry posts 214*a*, 214*b*, 214*c* disposed in notches 215*a*, 215*b*, 215*c* of actuator arms 216*a*, 216*b*, 216*c*. Referring to FIGS. 10 and 8, the arms 216*a*-216*c* extend from the central adapter 80 transversely to the axial dimension of the cap 60 and the arms 216*a*-216*c* are cantilevered from the central adapter 80. The arms 216*a*-216*c* are spaced apart by 120 degrees. Flexible strap members 218, 219, 220 also extend from the central adapter 80 and flexibly connect the central adapter 80 to the main peripheral wall 170 of the cap 60. The strap members 218, 219, 220 are disposed between the arms 216*a*-216*c* and are also spaced apart by 120 degrees. The strap members 218, 219, 220 and the arms 216 are disposed in recesses defined between the pillars 78*a*-78*f*. Referring to FIG. 8, a cover (not shown) could be fitted to the actuator cap 60 at the position of a phantom line 222 to shield the pillars 78, thereby preventing inadvertent dispensing of product during shipment. The cap 60 may include a ledge 224 modified as necessary for seating the cover. The actuator cap 60 may include a circumferential inwardly-tapered flange 226 and a plurality of spaced apart inwardly-directed beads 228. As shown in FIGS. 5 and 6, the flange 226 and the beads 228 are snap fitted over a rim 230 of the container 50.

Figure 13:
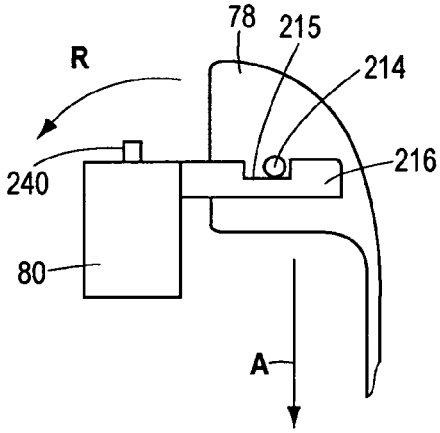
FIG. 13 is a diagrammatic and fragmentary side elevational view of components of the actuator cap of FIG. 1.
Figure 14:
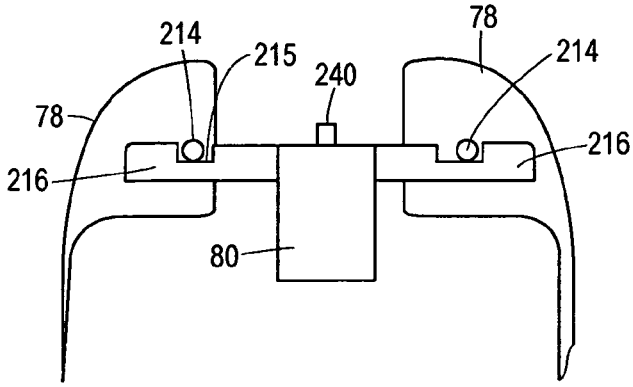
FIG. 14 is a diagrammatic and fragmentary side elevational view of components of an actuator cap similar to the actuator cap of FIG. 1.

Referring to FIG. 6, relatively moving the container 50 and the housing 70 such that the main body 56 of the container 50 and the discharge opening 82 are moved toward each other causes the peripheral surfaces 156 of the pillars 78 to engage the surface 164 of the tapered wall 108, thereby deflecting the pillars 78. During such deflection, the pillars 78 tip inwardly about the hinge point 174, bowing toward the central adapter 80. The posts 214*a*-214*c* press against the arms 216*a*-216*c*, thereby deflecting the arms 216*a*-216*c* and thus displacing the central adapter 80 axially toward the container 50. Sufficient displacement of the central adapter 80 to an actuating position thereof displaces the valve stem 52 into the container 50 such that product dispenses from the container 50, through a spray tip 240 of the nozzle member 190 and out of the housing 70. It should be noted that providing a plurality of the actuator arms 216 and the posts 214 at spaced apart positions, such as 180 degrees or 120 degrees, ensures substantially axial reciprocating movement of the valve stem 52, rather than tilting movement, potentially minimizing product discharge against the tapered wall 108. For example, referring to FIG. 13, if only a single pillar and actuator arm were employed, the central adapter 80 would tilt upon deflection of such single actuator arm. In contrast, it should be evident from FIG. 14 that providing multiple pillars and actuator arms, circumferentially spaced apart by a suitable distance, ensures substantially axial movement of the valve stem 52. It should also be noted that the notches 215 should preferably be sized larger than the posts 214. In this regard, considering the pillars 78 and thus the posts 214 traverse an arcuate path, oversizing the notches 215 accommodates radial sliding movement of the posts 214 as the posts 214 deflect the arms 216 axially toward the container 50.

Figure 15:
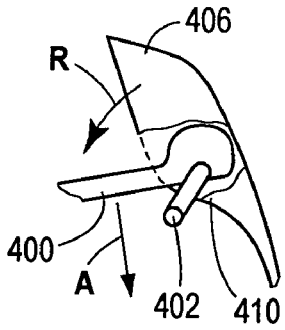
FIG. 15 is a diagrammatic and fragmentary side elevational view illustrating an alternative actuator arm and pillar design.

Referring to FIG. 15, an alternative actuator arm 400 could include a rod 402 or other projection extending therefrom into a deflection path R of one or more pillars 406, similar or identical to the pillars 78. As the pillar 406 moves along the deflection path R, a surface 410 of the pillar 406 pushes the rod 402, and thus deflects the actuator arm 400 axially in the direction of an arrow A.

Figure 16:
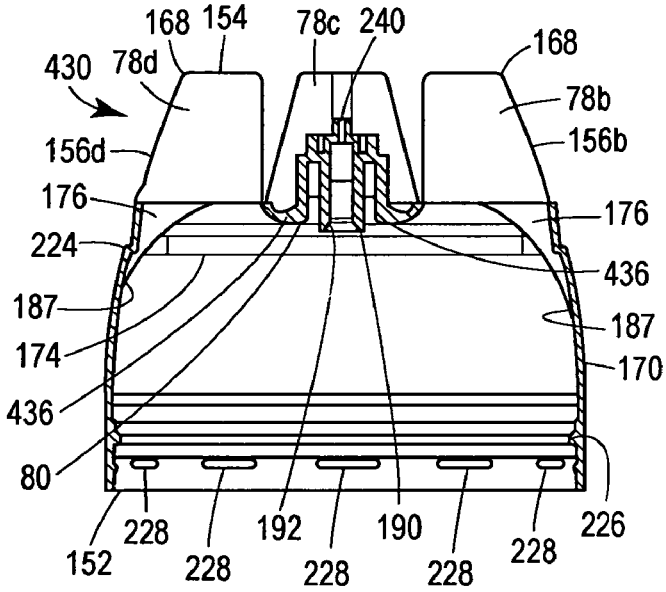
FIG. 16 is a full sectional view of an alternative actuator cap.

Referring to FIG. 16, an alternative actuator cap 430 includes one or more connection members 436 connecting the pillars 78 to the central adapter 80. Pivoting of the pillars 78 about the hinge point 174 pulls the connection members 436 axially toward the end 152 of the cap, thereby axially displacing the central adapter 80. The connection members 436 should be designed sufficiently rigid and/or sufficiently taut to provide sufficient axial displacement of the central adapter 80 when the pillars 78 are deflected.

Figure 17A:
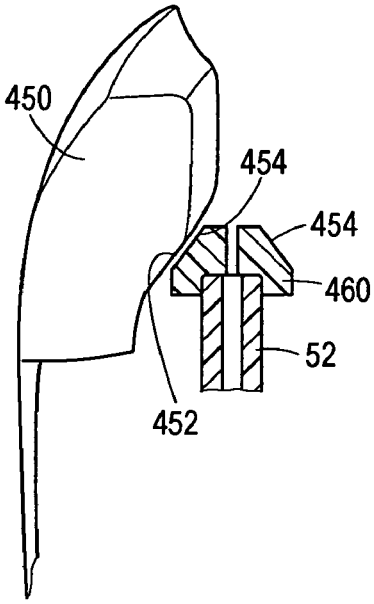
FIG. 17A is a diagrammatic and fragmentary isometric view partly in section illustrating an alternative adapter.

Referring to FIG. 17A, in an alternative arrangement, deflection of a pillar 450 brings a surface 452 of the pillar 450 into engagement with a sloped surface 454 of a flange 460 secured to the valve stem 52. Sufficient deflection of the pillar 450 displaces the valve stem 52 axially into the container 50 to effect dispensing.

Figure 17B:
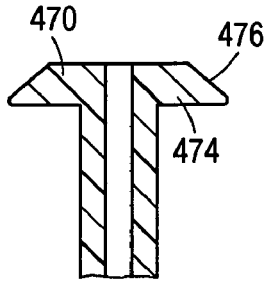
FIGS. 17B and 17C are fragmentary sectional views illustrating alternative valve stem designs.
Figure 17C:
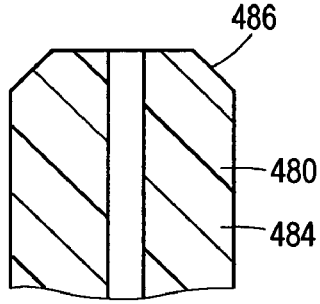

Referring to FIG. 17B, the flange 460 may be replaced by a valve stem 470 having an integral flange member 474. The flange member 474 includes a beveled surface 476 for engagement with the surface 452 of the pillar 450. Referring to FIG. 17C, an alternative valve stem 480 has a relatively thick wall 484 and a beveled surface 486.

Figure 12:
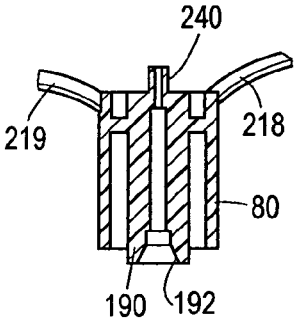
FIG. 12 is a sectional view taken generally along the lines 12-12 of FIG. 10.
Figure 12A:
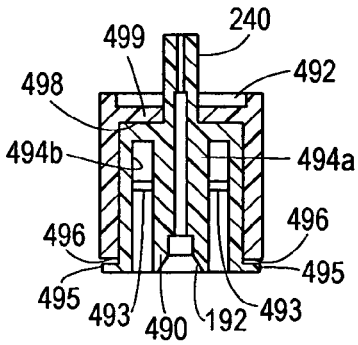
FIG. 12A is a sectional view similar to FIG. 12, but showing an alternative adapter.

Referring to FIGS. 12 and 12A, while FIG. 12 shows the adapter 80 having an integrally molded nozzle member 190, FIG. 12A shows that a separately molded nozzle 490 could be made and snap fitted within a separately molded adapter 492. One or more arms 493 may connect inner and outer walls 494*a*, 494*b* of the nozzle 490. The nozzle 490 includes a circumferential flange 495 that abuts a lower circumferential surface 496 of the adapter 492, and the nozzle 490 further includes a shoulder surface 498 abutting a circumferential wall 499 of the adapter 492.

Figure 18:
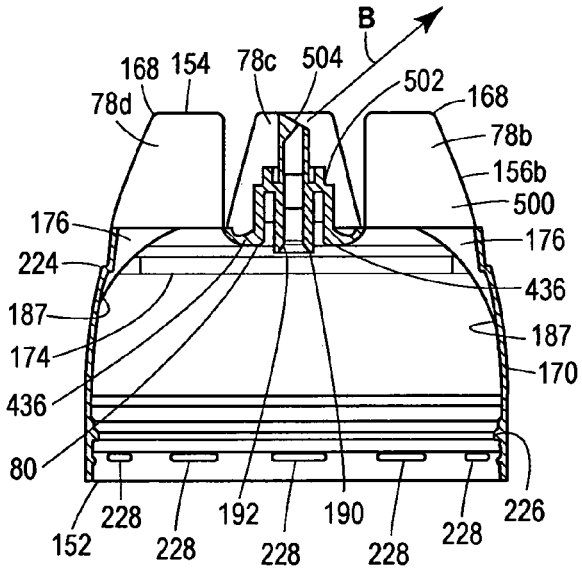
FIG. 18 is a diagrammatic full sectional view of an alternative actuator cap.
Figure 20:
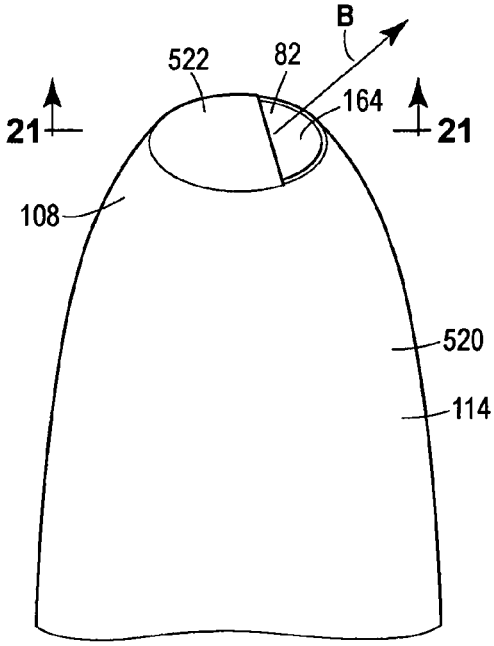
FIG. 20 is a fragmentary isometric view of a housing into which the components of FIGS. 18 and 19 may be placed.
Figure 19:
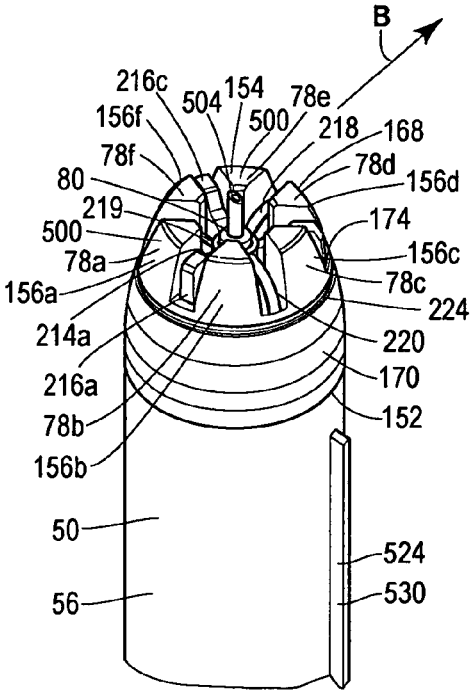
FIG. 19 is a fragmentary isometric view illustrating the cap of FIG. 18 secured to a container.
Figure 21:
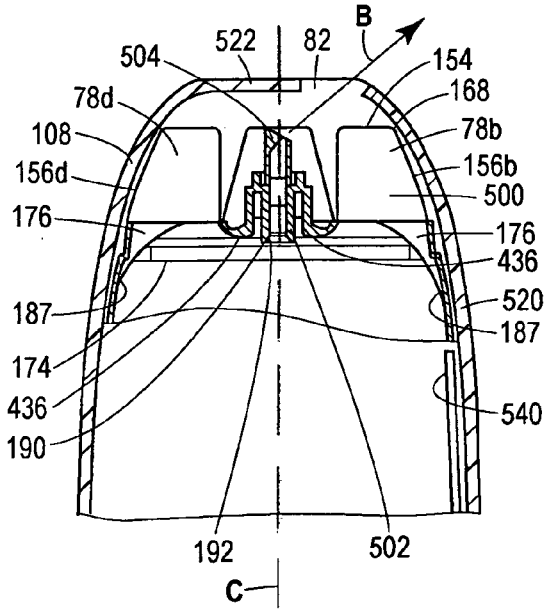
FIG. 21 is a diagrammatic sectional view taken generally along the lines 21-21 of FIG. 20 and further illustrating a fragmentary sectional view of the cap of FIG. 18.

FIGS. 18 and 19 illustrate an alternative actuator cap 500. The cap 500 includes an adapter 502 having a spray tip 504 that directs product discharge in the direction of an arrow B. (The details of the arms 216, the strap members 218-220, and the pillars 78 are omitted from FIGS. 18 and 21 for simplicity.) The angle of discharge from the centerline C may be of any suitable value less than 90 degrees, such as 15, 20, or 45 degrees. Referring to FIG. 20, a housing 520 may be provided for the cap 500, and the housing 520 includes a wall 522 that covers a portion of the discharge opening 82. If one attempted to use an actuator cap that discharges product axially along the centerline C, rather than at an angle thereto, such product would impinge against the wall 522. In the design of the components of FIGS. 18-21, one may provide any suitable structures for orienting the container 50 and the cap 500 in a particular orientation relative to the housing 520. For example, FIG. 19 shows that the container 50 may include a positioning key 524, such as a rib 530 that is radially aligned with the spray tip 504 for orienting the container 50 and the actuator cap 500 within the housing 520. FIG. 21 shows a slot 540 that receives the rib 530 to align the container 50 and the cap 500 such that the spray tip 504 discharges product out of the housing 520 rather than against the wall 522. It is within the scope of the invention(s) to alternatively provide a suitable key on the cap 500, rather than on the container 50, and a corresponding slot (not shown) for such key in the housing 520. In addition, one might alternatively provide the product refill with a particular shape corresponding to a particular internal shape of the housing 520 such that the product refill may only be disposed inside the housing 520 in a particular angular orientation.

The actuator cap embodiments disclosed herein may be designed to reduce the likelihood of inadvertent dispensing that might result from a user inadvertently shaking or jostling the housing 70 with the container 50 disposed therein. In this regard, the pillars 78 while deflectable toward the central adapter 80 have an inherent resistance to movement, and a manufacturer may increase or decrease this resistance as desired for a particular actuator cap design. For example, the pillars 78 may be provided with a resilient bias outward away from the central adapter 80. In order to axially displace the central adapter 80 a sufficient distance to the actuating position thereof, an amount of force must be applied that is sufficient to overcome the bias of the pillars 78, and thus move the pillars 78 to allow sufficient deflection of the actuator arms 216*a*-216*c* to the actuating position thereof.

Because the pillars 78 must be deflected in order for dispensing to occur, a sufficient amount of external mechanical force must act upon the actuator cap 60 to overcome the resistance provided by the pillars 78. In this regard, this resistance of the pillars 78 against movement provides a reactive force against forces directing the container 50 toward the discharge opening 82, such that this reactive force must be overcome before dispensing may occur. This reactive force is advantageous in that low force levels may be insufficient to overcome same to dispense product from the housing 70. For example, such low force levels may occur from a user jostling the housing 70 while walking or manipulating the housing 70 or may arise as a user shakes the housing 70 to mix the contents of the container 50. Such jostling could cause the cap 60 to be in a condition where the pillars 78 are slightly deflected and the actuator arms 216*a*-216*c* are either undeflected or deflected to a lesser extent than the actuating position thereof. Ideally, the reactive force provided by the pillars 78 prevents inadvertent dispensing until such time as the user intentionally applies sufficient force, thereby radially deflecting the pillars 78 and axially deflecting the actuator arms 216*a*-216*c* to the actuating position thereof. Thus, the user can pull the trigger 96 shown in FIG. 3 to intentionally dispense product, while inadvertent dispensing is avoided.

The foregoing embodiments may provide one or more of the following advantages.

First, because the deflectable pillars 78 have a sufficiently large value of L, the pillars 78 have an interfering relationship with the tapered wall 108, and thus, the actuator cap 60 is usable with the housing 70 despite the large discharge opening 82. (As noted above, the cross sectional size of the discharge opening 82 is greater than the container radius R.) Containers lacking an actuating apparatus of the length L are not usable with the housing 70. This may be useful because containers lacking a cap with the deflectable pillars 78 of length L may not be designed for use with the housing 70 or the housing 70 may not be marketed for use with a particular container of product that lacks the pillars 78. For example, the housing 70 may be marketed for use with a container of a specific type of insecticide having the actuator cap 60. A further advantage of the large discharge opening 82 and large value of L is that contact near the point of discharge 160 is avoided. Because the tapered wall 108 contacts the peripheral surfaces 156 at the distance L from the orifice of the valve stem 52, the potential for product obstruction or impingement is minimized. This feature could be especially advantageous for some products that fan out while discharging from the container 50 as the product gets farther away from the container 50. The large cross sectional size of the discharge opening 82 would accommodate such fanning out while minimizing potential product impingement or deposition thereupon. A further advantage of the large size of the discharge opening 82 is that the surface 164 of the tapered wall 108 might be potentially more easily manually accessed for cleaning than other housing types.

The product stored within the container body 56 could be any of a broad variety of products such as an air freshener, an insect control agent, a hair spray, a cleaning agent, a polishing agent, a fragrance, or other any other product stored in a container. Further, the product may be pressurized by a suitable propellant disposed within the container 50.

INDUSTRIAL APPLICABILITY

The foregoing embodiments are useful for dispensing a variety of products such as insecticides, cleaning products, air treatment products (e.g., air fresheners), or other products.

Numerous modifications to the present invention will be apparent to those skilled in the art in view of the foregoing description. Accordingly, this description is to be construed as merely exemplary of the inventive concepts taught herein and is presented for the purpose of enabling those skilled in the art to make and use the invention and to teach the best mode of carrying out same. The exclusive rights to all modifications which come within the scope of the appended claims are reserved.

We claim:

1. An actuator cap for a container of product in combination with a housing having a housing wall that tapers to a discharge opening, the actuator cap comprising:

a main peripheral wall;

a central discharge member axially movable relative to the main peripheral wall and oriented to discharge product substantially axially; and a pillar having a peripheral surface, the pillar being radially deflectable relative to the main peripheral wall in a direction toward the central discharge member;

wherein the pillar is disposed in interfering relationship with the housing wall and movement of the pillar is communicated to the central discharge member to displace the central discharge member when the pillar is deflected.

2. The actuator cap of claim 1, further comprising an additional pillar spaced from the pillar.

3. The actuator cap of claim 2, wherein centerlines of the additional pillar and the pillar are arcuately spaced apart by about 180 degrees.

4. The actuator cap of claim 1, wherein the pillar is connected to the central discharge member.

5. The actuator cap of claim 1, wherein the pillar is not connected to the central discharge member.

6. The actuator cap of claim 1, further comprising an actuator arm extending from the central discharge member in a direction from the central discharge member toward the main peripheral wall wherein movement of the pillar is communicated to the actuator arm which in turn axially displaces the central discharge member.

7. The actuator cap of claim 1, in combination with a container of pressurized product wherein product discharges from the container when the central discharge member is axially displaced.

8. The actuator cap of claim 7, wherein the discharge opening has a cross sectional size larger than a radius of the container.

9. The actuator cap of claim 2, wherein the pillars are biased radially away from the central discharge member.

10. The actuator cap of claim 1, wherein a distance is measured between an exterior surface of the pillar and an axial centerline of the cap and wherein the distance is greater than one-quarter the diameter of an end of the cap for fitting to the container.

11. The actuator cap of claim 7, wherein a distance is measured between an exterior surface of the pillar and an axial centerline of the cap and wherein the distance is greater than one-quarter the diameter of a main body of the container.

12. The actuator cap of claim 1, further comprising means for orienting the actuator cap in a particular angular orientation when placed into the housing.

13. The actuator cap of claim 1, wherein the peripheral surface is tapered.

14. A product refill in combination with a housing therefor, comprising:

a container of product;

a housing wall that tapers to a discharge opening; and an actuator cap including:

a main peripheral wall;

a central discharge member axially movable relative to the main peripheral wall and oriented to discharge product substantially axially; and a pillar having a peripheral surface, the pillar being radially deflectable relative to the main peripheral wall in a direction toward the central discharge member;

wherein the pillar is disposed in interfering relationship with the housing wall and movement of the pillar is communicated to the central discharge member to displace the central discharge member when the pillar is deflected; and wherein a length between the peripheral surface and an axial centerline of the cap is greater than about one-quarter a largest lateral dimension across the product refill.

15. The product refill of claim 14, further comprising an additional pillar spaced from the pillar.

16. The product refill of claim 14, wherein the pillar is connected to the central discharge member.

17. The product refill of claim 14, wherein the pillar is not connected to the central discharge member.

18. The product refill of claim 14, further comprising an actuator arm extending from the central discharge member in a direction from the central discharge member toward the main peripheral wall wherein movement of the pillar is communicated to the actuator arm which in turn axially displaces the central discharge member.

19. The product refill of claim 14, wherein the discharge opening has a cross sectional size larger than a radius of the container.

20. The product refill of claim 14, wherein the largest lateral dimension is a diameter of an end of the cap for fitting to the container.

21. The product refill of claim 14, wherein the largest lateral dimension is a diameter of a main body of the container.

22. The product refill of claim 14 further comprising means for orienting the product refill in a particular angular orientation when placed into the housing.

23. The product refill of claim 14, further comprising a positioning key.

24. The product refill of claim 23, wherein the positioning key comprises a positioning rib extending from the product refill.

25. The product refill of claim 14, wherein the container is cylindrical.

26. The product refill of claim 23, wherein the central discharge member is oriented to discharge product at an angle to an axial centerline of the cap and wherein the angle is less than 90 degrees.

* * * * *